United States Patent [19]

Kemper et al.

[11] 4,214,324

[45] Jul. 29, 1980

[54] HUMAN WASTE STORAGE AND DISPOSAL SYSTEMS FOR RAILROADS OR THE LIKE

[75] Inventors: James M. Kemper, Sherman Oaks; William I. Mercer, West Hills, both of Calif.

[73] Assignee: Monogram Industries, Inc., Santa Monica, Calif.

[21] Appl. No.: 935,065

[22] Filed: Aug. 18, 1978

[51] Int. Cl.[2] ..... E03D 9/10

[52] U.S. Cl. ..... 4/300; 4/314; 4/316; 4/319; 4/321; 241/46 R

[58] Field of Search ..... 4/312, 318, 115, 300, 4/314, 319, 320, 321, 323, 317, 431, 432, DIG. 3, 316; 210/15 Z; 241/46 R, 46 B, 46.17; 415/121 B

[56] References Cited

U.S. PATENT DOCUMENTS

| | | | |
|---|---|---|---|
| 2,779,948 | 2/1957 | Houle | 4/319 |
| 3,579,651 | 5/1971 | Russo | 4/316 |
| 3,673,614 | 7/1972 | Claunch | 4/320 X |
| 3,956,776 | 5/1976 | Broek | 4/317 |
| 4,041,555 | 8/1977 | Cole et al. | 4/300 |
| 4,115,876 | 9/1978 | Cole | 4/317 |
| 4,131,959 | 1/1979 | Albertassi et al. | 4/319 |
| 4,156,297 | 5/1979 | Pilolla | 4/319 X |

*Primary Examiner*—Frederick R. Schmidt

*Attorney, Agent, or Firm*—Poms, Smith, Lande & Rose

[57] ABSTRACT

A human waste storage and disposal system for railroads including a toilet bowl, a discharge outlet connected to the bowl, a flushing fluid inlet for flushing the bowl and a vertically disposed receiver coupled to the outlet for receiving the contents discharged from the bowl. A macerator is coupled to both the receiver and a storage tank for withdrawing waste from the receiver, macerating the same and discharging it into the storage tank. Suitable controls are provided for disposing of the macerated waste in the tank in situ or on demand.

6 Claims, 6 Drawing Figures

HUMAN WASTE STORAGE AND DISPOSAL SYSTEMS FOR RAILROADS OR THE LIKE

BACKGROUND OF THE INVENTION

1. Field of the Invention

The invention relates to toilets and human waste products disposal systems; and, more particularly, to a system for use on-board a vehicle, such as a railroad car, where a mixture of flushing fluid and human waste products can be disposed in situ.

2. Description of the Prior Art

On-site disposal systems are known in the art for disposing of the mixture of flushing fluid and human waste products resulting from use of toilets on vehicles, such as railroad cars. However, it may be inconvenient or contrary to law to dump such mixture at certain times or at any time, such as in environmentally protected areas, as harbors or stations or the like.

Generally, such systems use a known flushing medium for flushing the toilets, such as water or the like. Such vehicles also require a source of potable water for use in was basins or the like. Certain systems are installed on government-controlled railroads and must meet strict operating specifications. It can be appreciated that it is difficult to get the proper amount of efficiency out of such a system in the relatively small space available on railroad cars or the like. The problem is complicated by the storage capacity of the flushing medium on such cars and the limited amount of flush medium required so as to handle a predetermined number of flushes. Also, very difficult materials pass through such systems, as panty hose, sanitary napkins, etc.

SUMMARY OF THE INVENTION

It is an object of this invention to provide an on-board human waste disposal and storage system which can handle relatively difficult items of waste deposited into toilet bowls.

It is a further object of this invention to provide such a system which is capable of discharging the contents of a storage tank either in situ or on demand.

It is a still further object of this invention to provide such a system which can be used in small quarters yet provides an effective odor seal.

These and other objects are preferably accomplished by providing a toilet bowl, a discharge outlet connected to the bowl, a flushing fluid inlet for flushing the bowl and a vertically disposed receiver coupled to the outlet for receiving the contents discharged from the bowl. A macerator is coupled to both the receiver and a storage tank for withdrawing waste from the receiver, macerating the same and discharging it into the storage tank. Suitable controls are provided for disposing of the macerated waste in the tank in situ or on demand.

DESCRIPTION OF THE PREFERRED EMBODIMENT

Figures 1, 2:
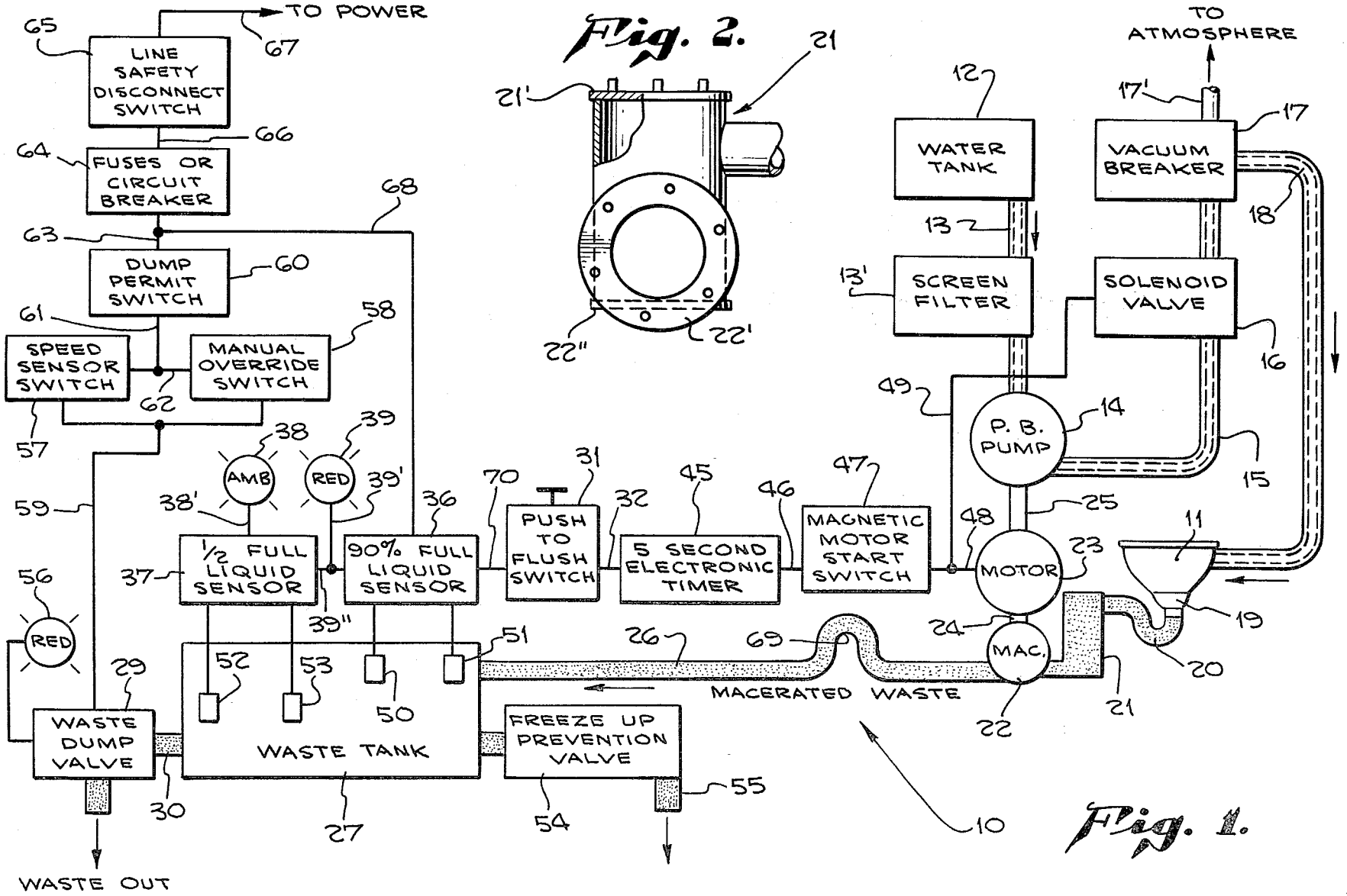
FIG. 1 is a schematic illustration of the system of our invention.
FIG. 2 is a detailed vertical view of a portion of the system of FIG. 1.

Referring now to FIG. 1 of the drawing, a system 10 in accordance with the teachings of the invention is schematically illustrated. A toilet bowl or commode 11 is provided which may be of conventional shape and of any suitable material, such as stainless steel. A water storage tank 12 is provided as by a car builder, preferably at a level above bowl 11, and includes a flow line 13 leading to a conventional flushing pressure boost pump 14 having an outlet line 15 leading to a conventional flush media supply solenoid valve 16. A conventional anti-siphon vacuum breaker 17 is coupled to solenoid 16 and has a discharge line 18 flushing into the top of bowl 11 as shown. Vacuum breaker 17 also includes a vent 17' to atmosphere. A screen filter 13' may be provided in line 13 between tank 12 and pump 14 to screen out large particles.

Bowl 11 has a discharge outlet 19 of a diameter adapted to restrict the passage of an object therethrough of a predetermined maximum diameter, such as two inches. A conventional S-shaped trap 20 is in fluid communication with outlet 19 and opens into a waste receiver 21.

As particularly contemplated in the present invention, receiver 21 is disposed between trap 20 and a macerator 22 to be described. Receiver 21 is preferably elongated, e.g., about 7 and $\frac{1}{4}$" in length and 3 and 5/16" in diameter, as shown in FIG. 2. Flange plate 22' is adapted to be coupled to macerator 22 and the opening thereof is generally flush with the bottom 22" of receiver 21. Receiver 21 is preferably of cylindrical configuration and vertically mounted. Receiver 21 is also of sufficient volumetric capacity, as will be discussed more fully, to receive waste matter from bowl 11. In this manner waste, along with atmospheric pressure, as will be discussed, waste flows by gravity into receiver 21 and to macerator 22. Receiver 21 may be closed off at the top by a transparent removable cover plate 21', as shown in FIG. 2.

Macerator 22, having an internal pumping mechanism, is coupled to receiver 21 driven by a motor 23 coupled thereto via shaft 24. Motor 23 is in turn coupled to flush pump 14 via shaft 25 and may be of any suitable type, such as a 115V. AC motor. A discharge line 26 leads from macerator 22 to a waste retention tank 27. Although the invention will be discussed hereinafter as storing waste in tank 27 obviously the macerated waste may be discharged directly into a city sewer or the like.

As illustrated in FIG. 1, components of system 10 may be disposed in a lavatory area, as on a train or the like, over the bowl 11. The vacuum breaker 17 is preferably also above the top bowl 11, as for example, at least 6" above the top thereof or about 18–20" above the center line level of S trap 20, to insure proper residual water retention. The waste retention tank 27 is below the bowl 11 and receiver 21, as for example, at some suitable location on the train or the like below the floor thereof. Tank 27 is of any suitable dimensions, such as having a volumetric capacity of about 176 gallons.

A dump valve 29 controls a waste discharge outlet 30 leading from the bottom of tank 27 for discharging waste in situ, as will be discussed.

A push button 31 is disposed at a suitable location for activating the system 10, such as a bulkhead of the lavatory in which the system is installed. Button 31 has an electrical conductor 32 leading to an electronic timer 45 e.g., about 5 seconds. An electrical conductor 46 leads from timer 45 to a magnetic motor start switch 47, switch 47 being coupling to both motor 23, via line 48, and valve 16, via line 49.

Tank 27 includes a 90% full waste level liquid sensing device 36 having probes 50, 51 extending into tank 27 and a half-full waste level liquid sensing device 37 having probes 52, 53 extending into tank 27. These devices 36, 37 are coupled to suitable illuminating lights 38, 39 via lines 39', 38', respectively, for indicating that tank 27 is 90% full and 50% full, respectively, so as to alert crew members to approaching pump-out or dumping. It is noted that line 39' is coupled to both devices 37, 36 via line 39''. Device 36 is coupled to switch 31 via line 70.

A freeze up prevention valve 54 is also provided on tank 27 having a discharge outlet 55. Both valves 29 and 54 may be manually operable for service drainage at select railroad yard maintenance points.

A signal light 56 may be coupled to valve 29. Although valve 29 has been disclosed as manually controlled, means are provided for electronically controlling valve 29. In the exemplary embodiment of the invention, a conventional speed sensor 57 and manual override switch 58 is coupled to valve 29 via conductor 59. A conventional dump permit switch 60 is coupled to both switches 57, 58 via lines 61, 62. Switch 60 is in turn coupled to conventional fuses or circuit breaker 64 via line 63. A line safety disconnect switch 65 is coupled to breaker 64 via line 66. Suitable power for the system 10, e.g., on-board batteries, may be provided via line 67 extending from switch 65. Finally, switch 60 is coupled to sensing device 36 via conductor 68.

OPERATION

In operation, after human waste and items normally deposited in a toilet, such as paper, are deposited in bowl 11, button 31 is depressed which signals timer 45 energizing motor start switch 47. This opens valve 16 and start motor 23. Thus, valve 16 is energized with breaker 17 closing its vent 17' allowing flushing media to enter bowl 11. Motor 23 drives both macerator 22 and pump 14.

The five second preferred flush cycle permits three pints of high pressure flushing fluid, e.g., water, to enter bowl 11 where it swirls around the bowl 11 several times. This high pressure swirl cleans bowl 11 better than would a greater amount of water under lower pressure. Thus, water use in conserved.

During the flushing cycle, macerator 22 pumps macerated waste over the loop 69 in discharge line 26 leading to tank 27 and thus into tank 27.

Since it may not be desirable or permissable to dump waste out of tank 27 at certain times and under certain circumstances, the tank 27 may become full. As it does, probes 52, 53, located at approximately the ½ level of tank 27, actuates device 37 lighting light 38. As the tank 27 fills further, the waste contacts probes 50, 51 of the 90% full device 36 and thus light 39 is activated. This simultaneously extinguishes the ½ full light 38 and, via line 70, deactivates the entire flushing system precluding further flushing and thus stopping the addition of more waste into tank 27.

Dump permit switch 60 permits drainage of waste from tank 27 via valve 29 and outlet 30 under select conditions. Switch 60 also precludes drainage under any condition except freeze-up. When switch 60 is in the "permit" mode, drainage will occur:

(a) When the speed sensor switch 57 receives a signal indicating that the vehicle in which system 10 is installed has attained a predetermined speed, e.g., 15 mph, this causes the waste dump valve 29 to open and discharge macerated waste from tank 27 out of outlet 30. The predeteremined speed requirement is necessary to distribute the waste so that a massive amount of waste is not dumped in any one place or at an undersirable location. Conversely, when the speed of the vehicle decreases below the predetermined rate, valve 29 automatically closes to preclude unwanted discharge.

(b) The actuation of the manual speed override switch 58 is provided to permit discharge of waste at the operator's discretion which might take place during a relatively long overlay period or some other time as where operation of the toilet system is necessary but a full tank 27 has caused sensing device 36 to shut down the system. The indicator light 56 is illuminated when valve 29 is actuated and remains lit until valve 29 completely closes.

Freeze-up prevention valve 54 is provided so as to be able to discharge the contents of tank 27 when the contents therein or the ambient air temperature approaches freezing thereby preventing damage to system 10.

It can be seen that the vigorous flushing action properly cleans the walls of bowl 11 and forms a liquid odor barrier precluding odors from entering the passenger section of the car, such as a railroad car.

On actuation of push button 31, waste and flushing media is drawn, by the vacuum created by macerator pump 22 and assisted by gravity, from bowl 11 through "S" trap 20 to receiver 21. Macerator pump 22 is activated by motor 23 and reduces the waste to a slurry which in turn is deposited in the tank 27 by the macerator pump 22.

After five seconds have elapsed, valve 16 closes and terminates water flow to bowl 11. The breaker 17 opens and allows residual water trapped in the line 18 between the vacuum breaker 17 and bowl 11 to exit into bowl 11, to fill the "S" trap 20 forming a hermetically sealed barrier to create a "wet bowl" and odor seal effect. Locating breaker 17 at a proper distance above bowl 11 ensures proper water volume retention.

Dump valve 29 can also be manually operated, through an internal override clutch, not shown if desired.

It can be seen that we have described an on-board sewage handling system where individual effluents deposited in water-flushed toilet bowls are macerated and transferred for temporary storage to a centrally located retention tank. The vacuum breaker allows residual water trapped in line 18 to enter the bowl 11 and S trap 20 forming a hermetically sealed barrier to create a wet bowl "effect and an odor seal". If the vehicle, such as a train, in which the system is installed is travelling at a proper rate of speed, as for example in excess of 25 MPH, the waste is discharged in situ, i.e., directly onto the roadbed. If desired, the waste can be stored in the waste retention tank long enough to permit subsequent drainage to a specific maintenance facility installation, as a wayside tank truck or sewer connection during periods of vehicle maintenance at a selected point. Optionally, the automatic discharge of waste may be manually overridden at any time, regardless of vehicle speed, to preclude discharge of waste in unauthorized areas.

Macerator 22 is capable of macerating all human waste solids, liquids, associated waste paper products, feminine hygiene items, panty hose, etc. Metal objects smaller in size than two inches in diameter pass through opening 19 and are collected in the sump of receiver 21 which receiver can be cleaned-out periodically.

Any suitable motor can be used, such as one capable of operating on the power of the vehicle, such as a railroad car. For example, a continuous duty single phase motor, 120 V AC, 60 Hz ¼ h.p., may be used having a nominal speed of 2400 RPM.

Any suitable effluent transfer pump in macerator 22 may be used, such as a close-coupled pump having a nominal flow rate of about 12 to 13 gallons per minute. A suitable effluent transfer pump is disclosed in copending application Ser. No. 660,646 filed Feb. 23, 1976 by Kemper, commonly assigned, the teachings of which are incorporated herein by reference.

Figure 3:
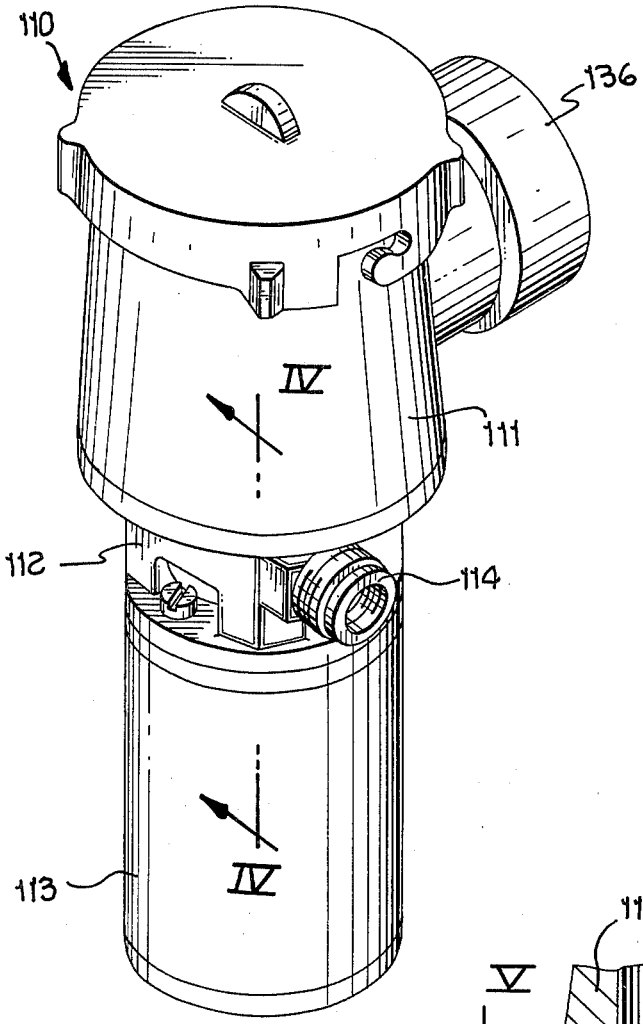
FIG. 3 is an isometric view of a macerator pump in accordance with the teachings of application Ser. No. 660,646.

Referring now to FIG. 3 of the drawing, a macerator pump 110 in accordance with the macerator pump disclosed in pending application Ser. No. 660,646. Pump 110 includes a collector housing 111 bolted or otherwise secured to a pump 112, pump 112 being bolted or otherwise secured to a conventional motor 113. Motor 113 may be any suitable motor, such as a 12 volt D.C. motor which can be run off of the battery of the vehicle or vessel, if desired, in which pump 110 is installed.

Pump 112 is a positive displacement vacuum pump having its inlet in fluid communication with the interior of collector housing 111, as will be described. The threaded outlet 14 of pump 12 is adapted to be coupled, if desired, to a conduit or the like (not shown) which may lead to a point opening exteriorly of the vessel or vehicle (also not shown) in which macerator pump 110 is installed (or to some other desired remote location).

Figure 5:
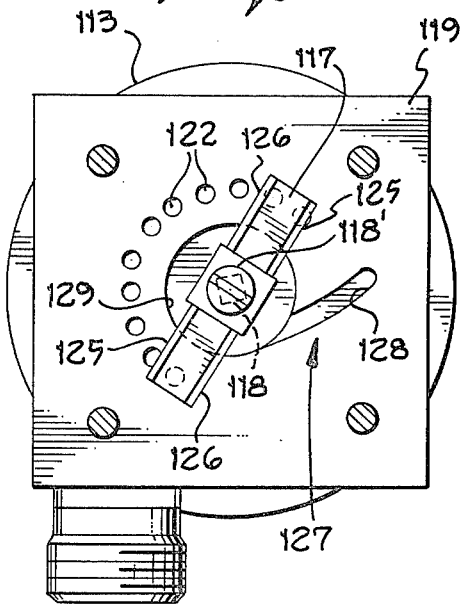
FIG. 5 is a view taken along lines V—V of the macerator pump of FIG. 4.
Figure 6:
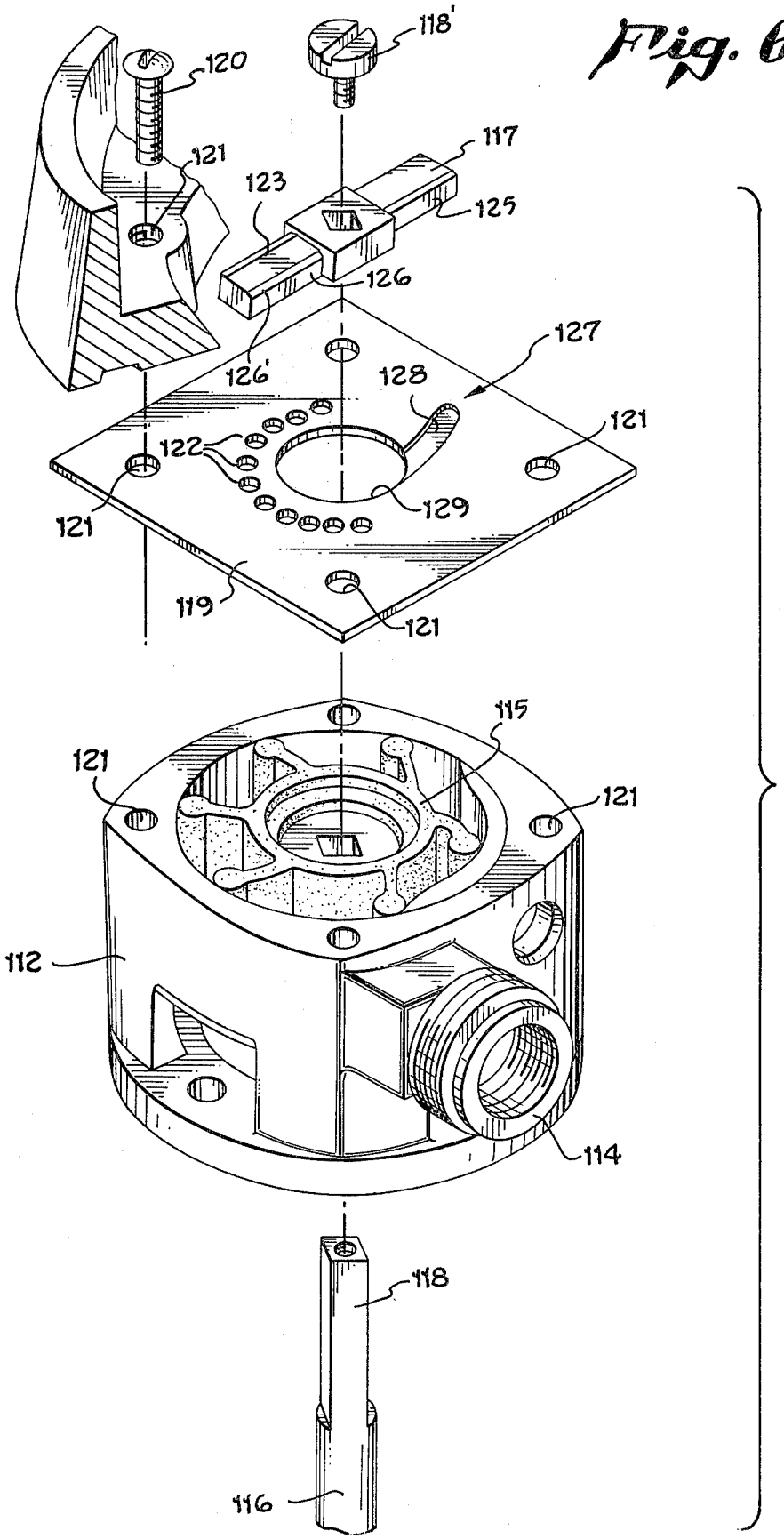
FIG. 6 is an exploded view of the macerator pump of FIG. 3.

The interior of pump 112 is shown more particularly in FIG. 6 and includes a flexible impeller 115, as is well known in the art, which is keyed to the shaft 116 (FIG. 5) of motor 113. It is to be understood that, as shaft 116 is rotated, impeller 115 sucks ground waste into the interior of pump 112 and pumps it out of outlet 114, as will be discussed.

Referring also to FIG. 5, a cutting blade 117 is fixedly secured to the end of shaft 16 in any suitable manner, such as being keyed to the end of shaft 116 or shaft 116 terminating in an end 118 (FIG. 4) having blade 117 keyed thereon (see FIG. 6) and retained thereon by a set screw 118'. A cutter plate 119 (FIGS. 5 and 6) separates pump 112 from collector housing 111. As shown in FIG. 6, screw 120 or the like are threaded through suitable apertures 121 in housing 111, plate 119 and pump 112 to secure the components together. Thus, no rotating components are present inside of housing 111 in front of blade 117.

Plate 119 includes a plurality of spaced apertures 122 of a predetermined size with cutting blade 117 being rotatable over apertures 122.

Figure 4:
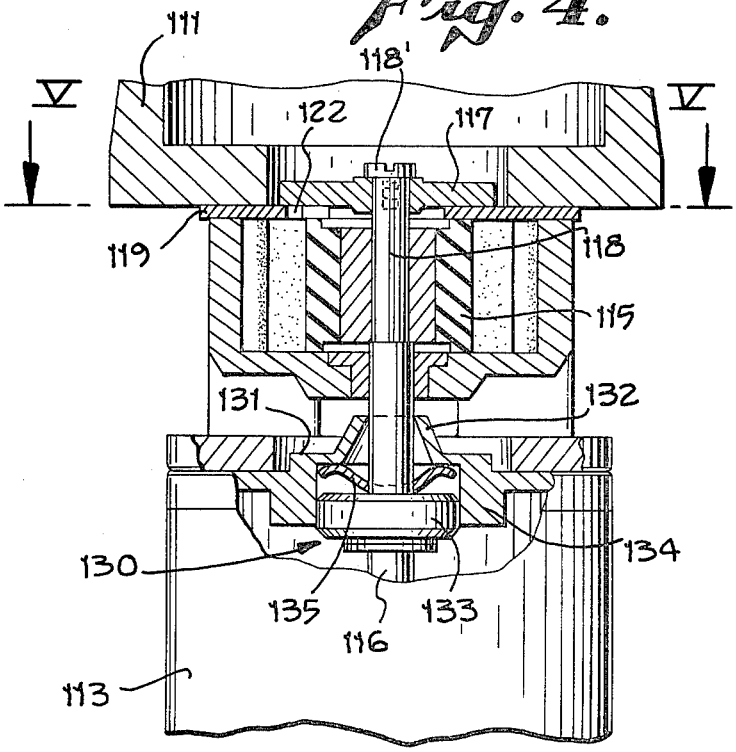
FIG. 4 is a view taken along lines IV—IV of FIG. 1.

Blade 17 is preferably reversible to present a pair of cutting edges on each side as seen in FIG. 4.

Plate 119 also includes in the exemplary embodiment blade cleaning means 127 for kicking back any materials caught between blade 117 and plate 119 into the interior of housing 111 thus cleaning blade 117. In the exemplary embodiment, such blade cleaning means 127 includes a curved groove 128 extending from a centrally located aperture 129 in plate 119 (receiving shaft 116 therethrough) and curving radially outwardly in the direction of rotation of blade 117.

Self-adjusting cutting blade means 130 are provided for retaining blade 117 in close proximity to plate 119 regardless of longitudinal movement of shaft 116. In the exemplary embodiment, such self-adjusting cutting blade means 130 includes a partition or plate 131 (FIG. 5), which may form a wall of the motor housing, separating pump 112 from motor 113, plate 131 having an upwardly extending apertured sleeve 132 integral therewith through which shaft 116 extends for preventing lateral movement of shaft 116. A bearing 133 is fixed to shaft 116 inside motor 113 and abuts against spring means 135 which bears against the underside of plate 131 as seen in FIG. 4. A reduced section 134 may be provided in plate 131 for accommodating bearing 133. Spring means 135, such as a spring washer, loosely encircles shaft 116 and is disposed between bearing 133 and plate 131. Any suitable spring means may be used. Thus, regardless of longitudinal movement of shaft 116, spring means 135 biases blade 117 against plate 119. An inlet 136 is provided (FIG. 3) leading into the interior of housing 111.

The operation of the macerator pump of FIGS. 3 through 6 is fully described in copending application Ser. No. 660,646.

Any suitable flush pump for pump 14 may be used such as a fixed displacement close-coupled impeller pump having a nominal flow rate of about 4.8 gallons per minute. Such pump should provide sufficient flow and pressure to creater a proper flush pattern and cleanse the sides of bowl 11.

Preferably, tank 27 is mounted below the floor of the vehicle to prevent freeze-up during cold weather. Baffles (not shown) may be provided to prevent sloshing of its contents. Materials for the remaining components may be selected to provide proper operation over a wide ambient temperature range, including storage time.

The preferable dimensions of tank 27, set forth hereinabove, have been selected to provide a tank capacity sufficient to handle up to 84 users comprising 5 uses a day with a flush volume of 2.8 pints and an approximate waste deposit of ½ pint per user use. Tank 27 may be of any suitable materials, such as welded steel, coated internally and externally with white epoxy resin for corrosion resistance. It should be structurally strong enough to withstand the severe vibrational and flying debris environment inherent in railroad operating conditions. Obviously, a plurality of bowl-receiver-macerator combinations can discharge into a single holding tank 27.

It can be seen that we have described a toilet system which uses vacuum, along with gravity to remove waste contents from a toilet bowl and pass the same into a macerator. Pressure forces the ground material into a treatment tank 27 or city sewer. Three pints of flush water enters the top of bowl 11 horizontally at high pressure and swirls around several times, cleansing the entire bowl 11. Waste is drawn by vacuum through a liquid trap into a vertical mounted waste receiver 21 of sufficient capacity to hold the entire contents of bowl 11.

The vacuum pressure grinder pump of macerator 22 is mounted horizontally on lower side of receiver 21. When toilet is flushed, timer 45 causes motor 23 to run and flush valve 16 to open for 5 seconds. The vacuum produced when macerator pump 22 is running causes the contents in receiver 21 to be drawn into the macerator blade. If the macerator of Application Ser. No.

660,646 is used, the macerated waste is drawn into holes in the cutter plate thereof and a blade mounted on the motor shaft shears off material lodged in the cutter plate holes. The vacuum pressure pump forces the ground material into the holding tank 27 or city sewer.

In the 5 seconds that the flush valve 16 is open, 3 pints of water is let into the bowl 11. The pump of macerator 22 is capable of pumping 8 pints of wet waste in 5 seconds. The 3 pints of flush water is mixed in receiver 21 with urine, waste and feces and any other material that has been thrown into the bowl 11. If more waste has been put into the bowl than the pump of macerator 22 is capable of grinding, in one 5 second flush cycle, the unground waste lays in the receiver 21 until the next flush cycle and no odor will be emitted from the bowl 11 because a water trap is formed via trap 20 between the bowl 11 and the receiver 21. Without a vertically mounted receiver 21 of sufficient capacity to hold the contents of bowl 11, the intake of macerator 22 would clog on objects such as panty hose and diapers which are normally thrown into toilet bowl 11. With only 3 pints of flush water and a bowl 11 full of trash, this small amount of water is now capable of wetting the contents of bowl 11. In a vacuum pumping system, enough water must be provided to wet the material so that a plug will be formed, then atmospheric pressure pushes the contents towards the source of vacuum.

The macerator 22 grinds all paper, cloth and rubber objects that will go through a two inch restrictor or outlet 19 mounted in the bottom of toilet bowl 11. Metal objects thrown into toilet 11 are rejected by the macerator and fall by gravity to the bottom of receiver 21. The removable transparent cover 21' on receiver 21 permits easily removal of such metal objects.

We have thereby disclosed a unique and novel toilet system which can handle a large volume of waste, such as on a train, with minimum amount of water.

We claim:

1. A human waste disposal system for a vehicle or the like comprising:

at least one toilet bowl;

a waste discharge outlet coupled to said bowl;

a flushing fluid inlet coupled to both said bowl and a source of flushing fluid;

an elongated vertically mounted receiver coupled directly to said outlet for receiving a mixture of waste and flushing fluid from said bowl, said outlet being coupled to said receiver at the top thereof macerator vacuum pumping means comprising a vacuum pump grinder and a motor having a rotatable motor shaft coupled to said pump grinder for actuating the same, said grinder including a positive displacement vacuum pump actuated by said motor shaft having a slurry discharge outlet and an inlet, an apertured plate closing off the inlet of said pump with said motor shaft extending through said plate, a collector housing for receiving said mixture therein having an inlet coupled to said receiver and an outlet coupled to said pump inlet with said plate separating said pump from said collector housing, a cutting blade fixed to the shaft of said motor and rotatable over said apertured plate on the side of said plate adjacent said collector housing, and blade biasing means associated with said motor and said motor shaft for biasing said blade against said plate, and said macerator vacuum pumping means being connected directly to said receiver at the bottom thereof for creating a vacuum whereby atmospheric pressure, combined with the force of gravity, pushes said mixture out of said receiver to and into said pumping means, said receiver including means therein for controlling the quantity of mixture being pushed into said pumping means while storing the remainer of said mixture adjacent said pumping means, said macerator vacuum pumping means macerating said mixture to form a slurry.

2. In the system of claim 1 wherein said discharge outlet is an S trap discharging into the upper end of said receiver and said macerator pump is in fluid communication with the lower end of said receiver, the lowermost portion of said macerator pump in fluid communication with said receiver being generally flush with the lowermost internal portion of said receiver.

3. In the system of claim 1 wherein said collector housing is horizontally oriented with respect to said vertically mounted receiver.

4. In the system of claim 1 wherein the opening of said collector housing inlet connected to said receiver is substantially flush with the bottom of said receiver.

5. In the system of claim 1 wherein the receiver has a cross-sectional area of about 3 5/16".

6. In the system of claim 1 wherein said receiver has a volumetric capacity of a size sufficient to receive the quantity of waste and flushing fluid normally held by said bowl and store said mixture therein.

* * * * *